United States Patent [19]

Yoshikawa et al.

[11] 4,215,862

[45] Aug. 5, 1980

[54] WATER-SURFACE TOWED TARGET

[75] Inventors: Takashi Yoshikawa, Yokohama; Shigeru Kato, Kamakura; Akira Obata, Yokohama; Hiroshi Shibazaki, Yokosuka; Shigeaki Ishikawa; Toshio Satoh, both of Yokohama, all of Japan

[73] Assignee: Japan Aircraft Mfg. Co., Ltd., Yokohama, Japan

[21] Appl. No.: 917,474

[22] Filed: Jun. 21, 1978

[30] Foreign Application Priority Data

Jun. 28, 1977 [JP] Japan ..... 52-84302[U]

[51] Int. Cl.[2] ..... A63B 71/02

[52] U.S. Cl. ..... 273/350; 114/245; 114/332; 273/359

[58] Field of Search ..... 114/332, 244, 245, 274; 273/105.2; 272/1 B

[56] References Cited

U.S. PATENT DOCUMENTS

| | | | |
|---|---|---|---|
| 650,758 | 5/1900 | Lake | 114/332 |
| 2,971,487 | 2/1961 | Plum | 273/105.3 |
| 3,112,725 | 12/1963 | Malrose | 114/90 |
| 3,433,195 | 3/1969 | Poole | 114/274 |
| 3,509,848 | 5/1970 | Salmon | 114/245 |
| 3,581,273 | 6/1967 | Hedberg | 114/244 |
| 3,648,635 | 3/1972 | Hashemi | 114/244 |
| 3,747,550 | 7/1973 | Stoeberl | 114/140 |
| 3,842,772 | 10/1974 | Lang | 114/274 |
| 3,868,920 | 3/1975 | Schirtzinger | 114/332 |
| 4,078,513 | 3/1978 | Dorsch | 114/244 |

*Primary Examiner*—Paul E. Shapiro

*Attorney, Agent, or Firm*—Frishauf, Holtz, Goodman and Woodward

[57] ABSTRACT

Disclosed is a water-surface target towed by a mother ship which comprises a towed member running underwater with a ballast weight suspended therefrom, a target pole set up on the top of the towed member, and a stabilizing plate attached to a position above the waterline of the target pole at an angle of incidence. The water-surface target can be used even under bad conditions and towed at a high speed, e.g. 30 knots, due to the towed member being capable of continually maintaining stability underwater.

13 Claims, 7 Drawing Figures

WL
θ

WATER-SURFACE TOWED TARGET

BACKGROUND OF THE INVENTION

This invention relates to a water-surface towed target towed by a mother ship for firing practice.

As targets available for sea firing practice, there are used water-surface towed targets to run towed by a mother ship.

According to one such target of the prior art, a support is set up on a catamaran-shaped towed member floating on the surface of the water, and a cloth target is attached to the support. In such target, however, the towed member, floating on the surface, may be overturned by the waves when towed at a high speed. Therefore, the target can be towed only as slowly as 10 knots or thereabouts, and only under good weather conditions. Further, the towed member is subject to breakdown by projectiles during the firing practice.

SUMMARY OF THE INVENTION

Accordingly, the object of this invention is to provide a water-surface towed target in which a towed member runs underwater to avoid shot damage, and the position of the towed member is continually maintained stable, thereby enabling use under bad weather conditions as well as highspeed towing.

DETAILED DESCRIPTION OF THE PREFERRED EMBODIMENT

Figures 1, 2, 3, 4, 5, 6, 7:
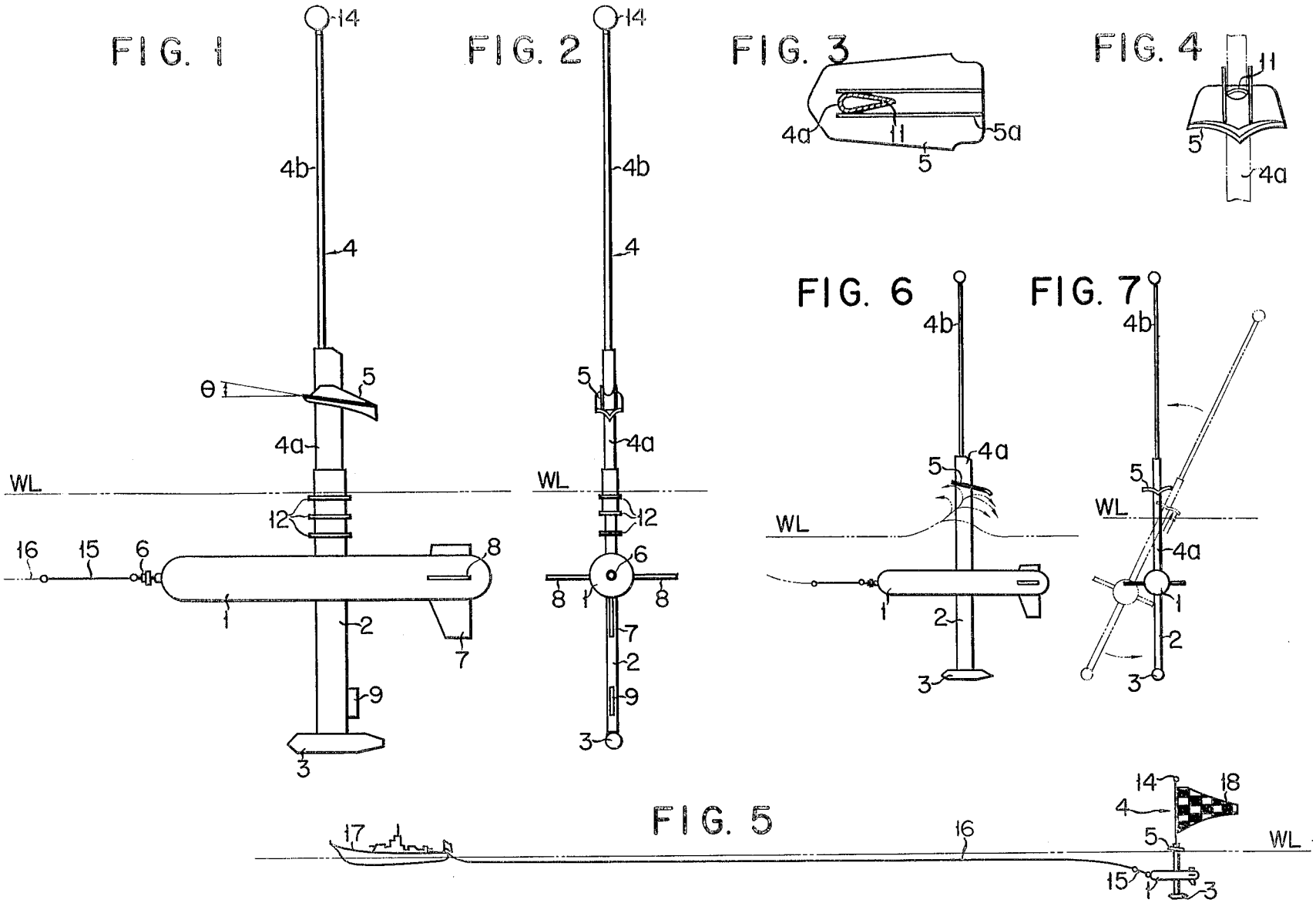
FIG. 1 is a side view of the towed target according to an embodiment of this invention.
FIG. 2 is a rear view of the target of FIG. 1.
FIG. 3 is an enlarged plan of the stabilizing plate.
FIG. 4 is an enlarged side view of the stabilizing plate.
FIG. 5 is a diagram illustrating the relation between the mother ship, the towed target of the invention, and the surface of the water while in towing.
FIG. 6 is a side view of the stabilizing plate showing the function thereof in towing.
FIG. 7 is a front view of the stabilizing plate of FIG. 6.

As shown in FIGS. 1 and 2, the water-surface towed target of this invention comprises a torpedo-shaped underwater towed member 1, a ballast weight 3 suspended under the towed member 1 by means of a support member 2, a target pole 4 set up on the towed member 1, and a stabilizing plate 5 attached to a position above the waterline of the target pole 4 at an adjustable angle of incidence $\theta$, the specific construction of which will be described in detail as follows.

The towed member 1 is formed by filling a foam resin into a watertight casing made of metal or reinforced plastic (or combination of these materials). The forward end of the towed member 1 is fitted with a towrope coupling 6, while a set of vertical stabilizers 7 and another set of horizontal stabilizers 8 are fixed to the rear end. The support member 2 is a metal or plastic pillar which has the same sectional shape as that of a mast support 4*a* as mentioned later, the upper end of the support member 2 being removably fixed to the towed member 1. Numeral 9 designates an auxiliary stabilizer attached at right angles to the lower-end back of the support member 2. The ballast weight 3, which has a streamlined shape, is removably attached to the bottom end of the support member 2 in parallel with the towed member 1. The target pole 4 comprises the mast support 4*a* set up on the top of the towed member 1 and a mast 4*b* removably fixed to the top end of the mast support 4*a*. As shown in FIGS. 3 and 4, the stabilizing plate 5 attached to the target pole 4 is formed in the same shape as that of the bow side bottom of a high-speed boat, and is fixed to the upper end portion of the mast support 4*a* with an angle of incidence $\theta$, having a mast support fitting hole 11 fitted thereon. A plurality of boundary layer plates 12 are put on the outer periphery of the bottom portion of the mast support 4*a* which has a winglike section, as shown in FIG. 3. The boundary layer plates 12 are intended for preventing air from being sucked in along the mast support 4*a* in case the surface of the mast support 4*a* is subjected to fluid separation while the target is being towed. With these boundary layer plates 12, there will not be formed any air layer around the towed member 1 and the mast support 4*a*, thereby preventing the difference in pressure between each side of the mast support 4*a* and securing stabilized underwater running of the towed member 1 maintaining the perpendicularity of the target pole 4.

Now there will be described the manner of towing the target with the above-mentioned construction.

The water-surface towed target is carried on a mother ship to a practice sea area, where a spherical radar reflector (Luneberg lens) 14 is attached to the top end of the mast 4*b*, a towrope 16 (approx. 1,200 to 3,600 m long) is fastened to a steel wire rope 15 a few meters long previously coupled to the towrope coupler 6, and the target is lowered onto the sea. A floating rope is used for the towrope 16. When the target is launched on the water, the towed member 1 floats on the surface of the water by its buoyancy, and is stabilized with the target pole 4 made perpendicular to the water surface by the function of the ballast weight 3. Thereafter, the towed member 1 towed by the mother ship 17, as shown in FIG. 5, submerges as the towing speed increases, and runs underwater in a horizontal position when it balances the buoyancy caused by the stabilizing plate 5 at the angle of incidence $\theta$. The stabilizing plate 5 is located so as to prevent the towed member 1 from submerging to an excessive depth. The horizontally running towed member 1 may be located at a position a few meters deep from the water level WL by the stabilizing plate 5, which is attached to the mast support 4*a* a little above the water level WL. In this case, sprays of water hitting against the mast support 4*a* may be caught by the stabilizing plate 5 in such a manner as shown in FIG. 6, so that these sprays of water will never jump high in the air to damage the radar reflector 14. Moreover, if the target inclines as shown in FIG. 7, the stabilizing plate 5 restores the target pole 4 to the normal position by means of a righting moment caused by the tilt angle in conjunction with the ballast weight 3. A distant firing practice using the target towed on the water in this manner is made with the position of the target picked up by a radar and the impact area identified from a mother ship 17. Further, the target of the invention may be used also for short-distance visual firing practice. In this case, a target flag 18 or the like may be attached to the mast 4*b* as required.

Although in the above embodiment the towed member 1 is of a torpedo shape, it may be of any shape so long as it is streamlined. Since the target pole 4 itself may be used as a target, it may be rendered replaceable in case it is shot and broken.

Thus, the water-surface towed target according to this invention has the aforementioned construction, and the towed member runs underwater to avoid shot damage, the position of the towed member is continually maintained stable by means of the ballast weight and the stabilizing plate, thereby enabling towing at a high speed (approx. 30 knots) as well as use under bad weather conditions.

What we claim is:

1. A water-surface towed target comprising:

a towed member running substantially at a predetermined depth under the surface of the water when towed by a mother ship, a ballast weight suspended under said towed member by means of a support member, a target pole mounted on the top of said towed member and extending above the surface of the water, said target pole carrying a target at the upper portion thereof, and a shaped stabilizing, spray deflecting and depth maintaining plate attached to said target pole and extending substantially symmetrically laterally outward from both sides of said pole, the lowermost portion of said plate being at a position a small distance above the waterline of said target pole when said towed member is substantially at the predetermined depth, the portions of said plate on opposite sides of said pole being generally equally spaced vertically above the surface of the water when said pole is vertical, said plate being attached to said target pole at an adjustable angle of incidence to the surface of the water for deflecting upwardly sprayed water downwardly for preventing water spray from affecting the target, for maintaining the depth of the submerged towed member substantially at a predetermined depth and for stabilizing the target by substantially preventing rolling of the target.

2. A water-surface towed target according to claim 1, wherein said towed member comprises a generally elongated cylindrical intermediate portion having generally rounded streamlined forward and rear ends, a tow rope coupler attached to the forward end and vertical and horizontal stabilizers fixed to the rear end portion.

3. A water-surface towed target according to claim 2, wherein said ballast weight has a streamlined section.

4. A water-surface towed target according to claim 3, wherein said target pole comprises a mast support and a mast removably fitted therein, said mast support having a winglike section.

5. A water-surface towed target according to claim 4, wherein said stabilizing plate has substantially the same shape as that of the bow side bottom of a high-speed boat and a mast support fitting hole in the forward end portion, said hole being fitted on the upper end portion of said mast support.

6. A water-surface towed target according to claim 5, comprising a plurality of boundary layer plates attached to the bottom portion of said mast support.

7. A water-surface towed target according to claim 6, wherein the setting position of said stabilizing plate on said mast support is adjustable.

8. A water-surface towed target according to claim 1, wherein the upper end of the support member is removably fixed to the towed member and the ballast weight is removably attached to the bottom end of the support member in parallel with the towed member.

9. A water-surface towed target according to claim 1 wherein said stabilizing plate has substantially the same shape as that of the bow side bottom of a high-speed boat.

10. A water-surface towed target according to claim 1 wherein said stabilizing plate comprises an elongated member having a sectional shape in a direction perpendicular to the direction of movement of said towed member which is generally V-shaped, the legs of the V-shape being generally concave in the direction toward the surface of the water.

11. A water-surface towed target according to claim 10 wherein said stabilizing plate is adjustably attached to said target pole with its longitudinal axis at an adjustable angle of incidence to the surface of the water.

12. A water-surface towed target according to claim 10 wherein said target at the upper portion of said target pole comprises a radar reflector which is protected from water spray by said stabilizing plate.

13. A water-surface towed target according to claim 1 wherein said target at the upper portion of said target pole comprises a radar reflector which is protected from water spray by said stabilizing plate.

* * * * *